United States Patent [19]

Borelly

[11] 4,192,057

[45] Mar. 11, 1980

[54] PROCESS AND APPARATUS FOR THE PRODUCTION OF CORROSION PROTECTION FOR CABLES MADE OF PARALLEL WIRE STRANDS

[76] Inventor: Wolfgang Borelly, Schwanenstrasse 2c, 6800 Mannheim 51, Fed. Rep. of Germany

[21] Appl. No.: 738,545

[22] Filed: Nov. 3, 1976

Related U.S. Application Data

[60] Continuation-in-part of Ser. No. 631,322, Nov. 12, 1975, Pat. No. 4,117,582, which is a division of Ser. No. 439,742, Feb. 5, 1974, Pat. No. 3,919,762, which is a continuation-in-part of Ser. No. 385,683, Aug. 6, 1973, abandoned.

[30] Foreign Application Priority Data

Nov. 4, 1975 [DE] Fed. Rep. of Germany ..... 2549299

[51] Int. Cl.[2] ..... B23P 3/00

[52] U.S. Cl. ..... 29/458; 29/33 E; 57/7; 156/54; 156/180

[58] Field of Search ..... 29/458, 461, 33 E, 33 F, 29/33 K, 33 S; 14/22, 23; 228/130, 148, 219, 222; 57/7, 149, 162, 31, 32, 217, 223, 232, 258; 156/180, 54

[56] References Cited

U.S. PATENT DOCUMENTS

| | | | |
|---|---|---|---|
| 1,794,902 | 3/1931 | Johnson | 228/148 |
| 1,797,759 | 3/1931 | De Fores | 14/22 |
| 1,895,734 | 1/1933 | Rush | 14/22 |
| 2,141,138 | 12/1938 | Howe et al. | 14/23 |
| 2,765,527 | 10/1956 | Fairfield et al. | 29/33 F |
| 3,457,717 | 7/1969 | Durkee et al. | 14/22 |
| 3,526,570 | 9/1970 | Durkee et al. | 14/23 X |
| 3,681,911 | 8/1972 | Humphries | 57/162 X |
| 3,733,225 | 5/1973 | Moody | 156/54 |
| 3,800,522 | 4/1974 | Hughes et al. | 57/149 |
| 4,057,956 | 11/1977 | Tolle | 57/149 |

FOREIGN PATENT DOCUMENTS

| | | | |
|---|---|---|---|
| 2130874 | 10/1972 | France | 228/219 |
| 852212 | 10/1960 | United Kingdom | 228/219 |

*Primary Examiner*—John Sipos

*Attorney, Agent, or Firm*—Schwartz, Jeffery, Schwaab, Mack, Blumenthal & Koch

[57] ABSTRACT

Disclosed are a relatively or completely maintenance-free tension member suitable for construction of structures, such as cable stayed bridges and a method and apparatus for producing such tension members.

16 Claims, 10 Drawing Figures

PROCESS AND APPARATUS FOR THE PRODUCTION OF CORROSION PROTECTION FOR CABLES MADE OF PARALLEL WIRE STRANDS

CROSS-REFERENCE TO RELATED APPLICATIONS

This is a continuation-in-part of my copending application Ser. No. 631,322, filed Nov. 12, 1975 now U.S. Pat. No. 4,117,582, which is a divisional of application Ser. No. 439,742, filed Feb. 5, 1974, now U.S. Pat. No. 3,919,762, which is a continuation-in-part of application Ser. No. 385,683, filed Aug. 6, 1973 and now abandoned.

BACKGROUND OF THE INVENTION

The present invention relates to a process for producing tension members and more especially for producing corrosion-resistant parallel wire cables. For the construction of large-span cable stayed bridges of steel or reinforced concrete and for similar structural applications, and also for reactor construction, tension members with an especially high carrying capacity are required. They can be produced as bundles of an appropriately large number of parallel arranged wires.

Wires or stranded wires with a greater cross-section than customarily used up until now (7 to 10 mm diameter with nominal tensile strengths of 1600 to 1800 $N/mm^2$) should be used with the objective of obtaining a allowable load strength of at least 1000 Mp (1000 KN). For this purpose, the following operating steps can be carried out without difficulties by using a newly developed process, which comprises the steps of:

a. Winding such heavy parallel wire bundles up on reels in the central fabrication plant, after the anchoring members have already been cast there, in order to assure reliably equal wire lengths within the individual bundles; and b. Unwinding of the parallel wire bundles at the construction site, following transportation, so that the individual wires must not sustain, in this process, any edge damage or tensions which exceed the elastic limit. See U.S. Pat. No. 3,919,762, the disclosure of which is hereby incorporated by reference.

In order to make possible an economical application of these high-performance tension members in large bridge constructions, especially in the construction of cable stayed bridges, it is necessary to be able to produce a reliable protection against corrosion with sufficient resistance against longterm influences of unconstrained weathering.

To date, no completely satisfactory corrosion protection measures have become known, particularly none which are sufficiently effective against attacks from the atmosphere in the case of waste-gas-producing industry. In addition, known measures can usually only be finally carried out after assembly of the tension members is completed in the exposed position, namely, in the air from suspended baskets, scaffolds, or cable gangways (rat worms), with a high labor cost and with interference from unfavorable weather influences. This makes it difficult to perform a continuous careful monitoring of the work which is carried out.

To date, considerable damage after the passage of a certain amount of time has been found on the corrosion protecting coatings of paints, lacquers, and synthetic resins, which appeared especially suitable for an economical implementation for reasons of price and quality, due to the influence of the ultraviolet rays, as well as the especially disadvantageous influences of the oxygen in the air with sun radiation and at higher temperatures. The life span of these corrosion protection coatings is thus reduced to a degree which has so far been controllable with difficulty in practice. The repair of the tension members, which are located in an exposed position, is difficult and very costly.

Added to this is the fact that the penetration of moisture, especially of gases, into the initially still undamaged synthetic skin by diffusion, as well as of aggressive liquids into the cracks which form with time, and thus the beginning of the corrosion on the very sensitive high-strength wires can be reliably monitored only with difficulty. This is particularly very critical because, as is known, an embrittlement of the material occurs in the course of time in the case of synthetic materials, which are exposed to open weather, particularly those of the group of thermoplastics, even with the addition of carbon black, and the notches which develop on the surface further propagate as cracks toward the inside in the case of any mechanical stresses which may occur.

In order to be able to determine if and when a destruction has occurred on the inside of the parallel wire bundles, a constant careful and thus costly individual in situ control must be carried out after a certain number of years following installation. A reliable method is not yet known for this. It is therefore an urgent requirement to find a corrosion protection process which enables a life span of the parallel wire bundles which at least corresponds to, if not exceeds, that of the bridge which is supported by this tension members. Even higher expenses in the production of these corrosion protected parallel wire bundles appear to be justified if it is possible to avoid the previous uncertainty with respect to the life span of these tension members, the necessity for a constant careful monitoring, as well as the relatively high repair costs.

Therefore, a process which makes it possible to apply such a corrosion protection of the tension members, especially of the parallel wire bundles, *prior to the completion of the assembly,* at the construction site, under a small protective roof, appears to be especially advantageous. Here, a technically adequate quality control of the corrosion protection can be carried out. Under these conditions, the investment for constantly reusable, easily transporable apparatus which is necessary for the implementation of the corrosion protection process, as well as for a special installation process which is necessary for these protected tension members, is also justified economically.

Some proposals for a corrosion protection for parallel wire bundles are already available, see, e.g., DT-OS No. 23 57 006, as well as Japanese application No. 100,346/75 and U.S. Pat. No. 3,919,762. However, certain further developments have, in part, proven to be significant in practical application. In particular, they could be improved with respect to an effective longterm protection against weather influences.

SUMMARY OF THE INVENTION

An objective of this invention therefore resides in providing a process, with the avoidance of the above-described disadvantages, with which a completely effective and particularly stable corrosion protection can be produced.

Another object of the invention is to provide such a process according to which the corrosion protection can be applied, at the installation site.

It is also an object to provide a process for on-site application of corrosion protection in the functional connection with the unwinding of the parallel wire bundle from a supply drum, in an operating process which runs parallel in time.

Another object of the invention is to provide such a process which can be carried out in the vicinity of the installation point in a relatively small, easily assemblable protective room of transportable individual components, by means of assemblable, container-shipped apparatus, whereby the quality can thus be easily monitored.

It is furthermore an object of the invention to provide a process according to which, in the subsequent assembly processes, every conceivable damage of the surface of the applied corrosion protection can be avoided with certainty.

Yet another object of the invention is to provide an assembly process which is carried out automatically and is self-controlling, in order to exclude the influences of human shortcomings, and thus the possibilities of damage which could be connected therewith.

In accomplishing the foregoing objects, there has been provided in accordance with one aspect of the present invention a process for production of a relatively or completely maintenance-free tension member suitable for construction of cable stayed bridges, comprising the steps of: (a) conveying a bundle of wire members, preferably parallel wire members and most preferably unreeling prefabricated parallel wire members from a drum; (b) applying a corrosion-protective composition to the wire members and to the interstices therebetween; and (c) forming around the bundle of wire members a metal casing which is longitudinally relatively rigid and which may not be bent beyond a predetermined minimum radius of curvature without forming deformations therein, whereby the resulting metal encased tension member must remain in an extended configuration.

In accordance with another feature of the invention, there has been provided an apparatus for production of a relatively or completely maintenance-free tension member suitable for construction of cable stayed bridges, comprising: (a) means for conveying a bundle of wire members; (b) means for applying a corrosion-protective composition to the wire members and to the interstices therebetween; and means for forming around the bundle of wire members a metal casing which is longitudinally relatively rigid and which may not be bent beyond a predetermined minimum radius of curvature without forming deformations therein, whereby the resulting metal encased tension member must remain in an extended configuration.

Other objects, features and advantages of the invention will become apparent from the following detailed description of preferred embodiments, when considered with the attached figures of drawing.

FIG. *2a* is a schematic plan view of another part of an apparatus for producing the tension members according to the invention;

FIG. *2b* is a top view of FIG. *2a;*

Figure 8:
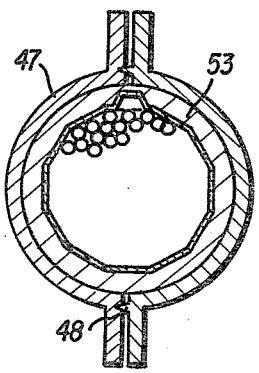
Figure 7:
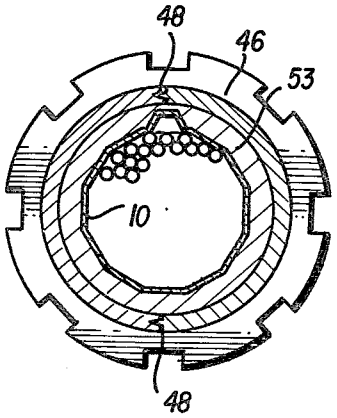
Figure 5:
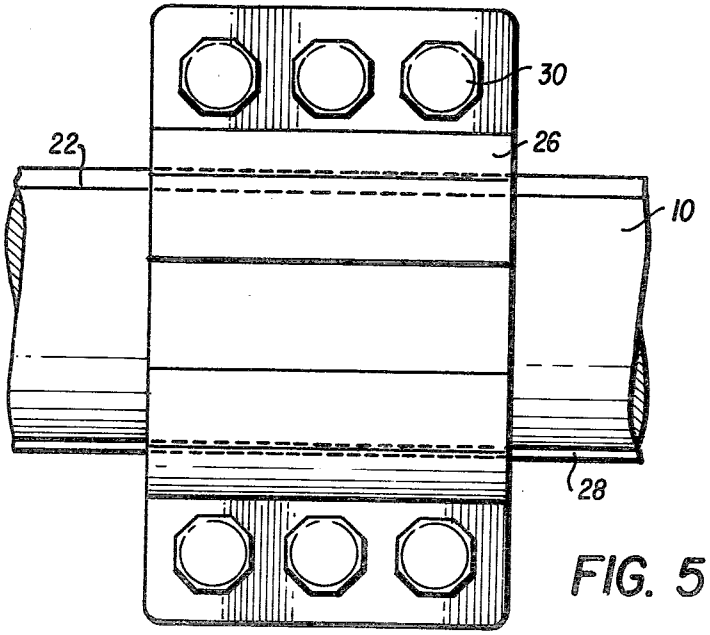
Figure 6:
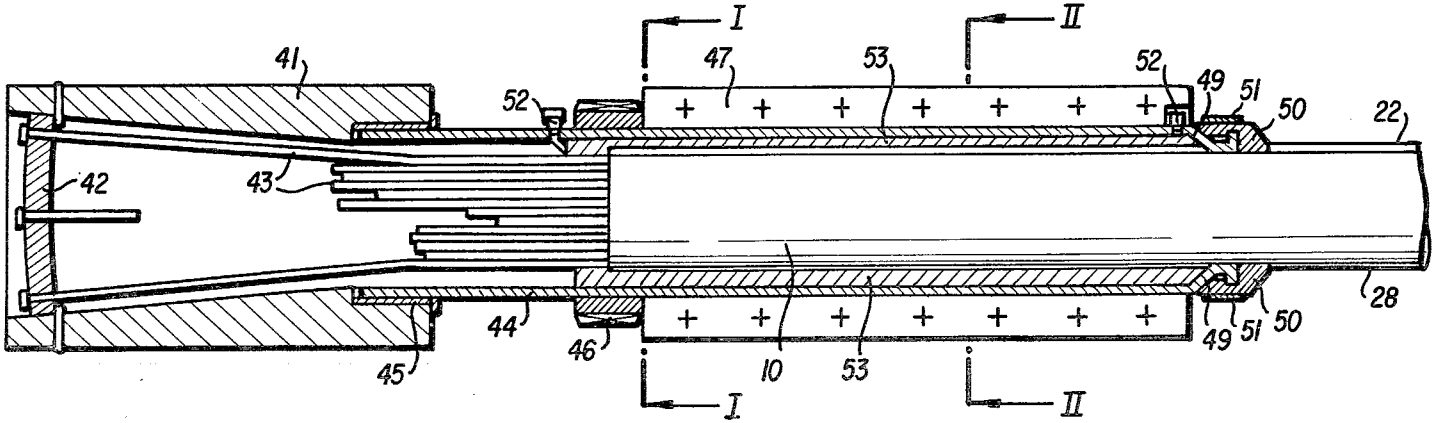
Figure 4:
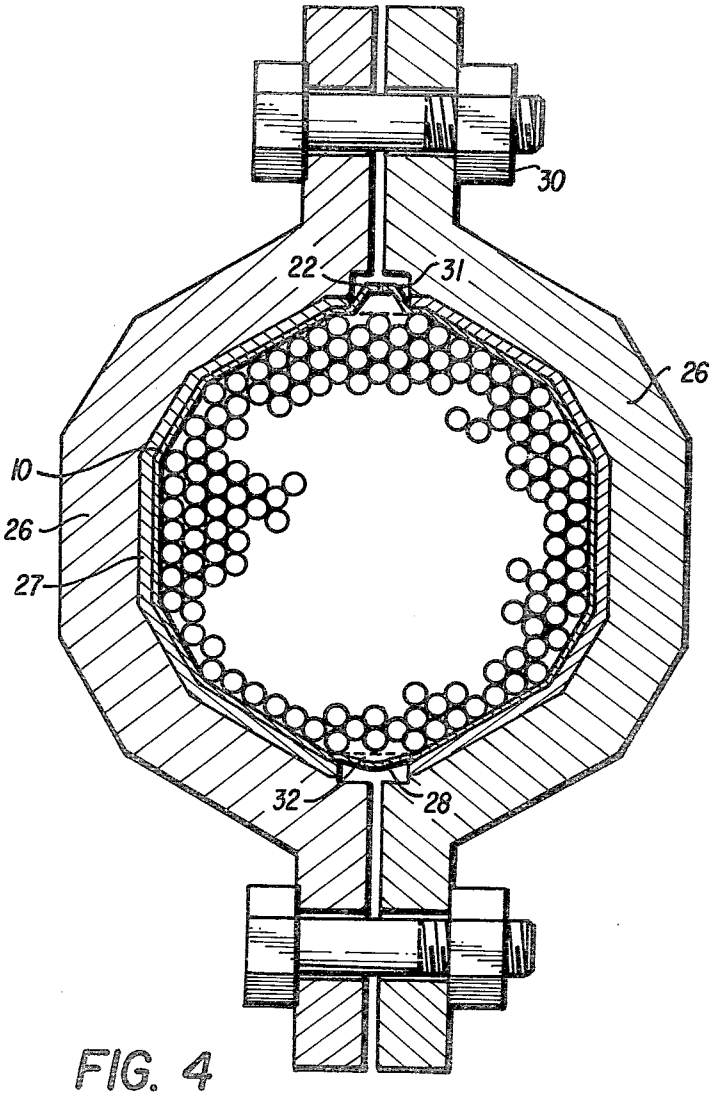

FIGS. *3a* and *3b* are partial cross-sectional views through a tension member and the apparatus for producing same;

FIG. 4 is a complete cross-sectional view through a tension member and the apparatus for producing same;

FIG. 5 is a plan view of a section of a tension member and a compression collar attached thereto;

FIG. 6 is a plan view, partially in section, of a telescoping attachment of the tubular shell to the anchor lead in a tension member;

FIG. 7 is a cross-sectional view taken along the line I—I in FIG. 6; and FIG. 8 is a cross-sectional view taken along the line II—II in FIG. 6.

DETAILED DESCRIPTION OF PREFERRED EMBODIMENTS

Thus, the process in accordance with this invention for the production of a maintenance-free or, if costs must be reduced, almost maintenance-free corrosion protection in connection with the associated assembly process which is adapted to the particular properties of this corrosion protection, represents a functional, inseparable unit. It has of course been shown that it is of little use to apply a high-value weather-resistant corrosion protection to the parallel wire bundle prior to installation if it would not be possible to maintain an almost taut form of the tension member, by means of a process especially developed for this purpose, during the subsequent installation.

This invention concerns only mechanically implementable processing steps which are carried out for the most part under a roof at the construction site during the unwinding of the supplied parallel wire bundles from the drum, and after the application of the corrosion protection skin, are carried out for a small part in the open.

The following individual steps are typically included:

1. Covering the individual wires with a suitable synthetic material (see FIG. 1) for example polyurethane, epoxy resins, or synthetic materials with similar properties, possibly with the addition of a passivating means such as zinc chromate or lead oxide, this being compatible with the material of the enveloping skin which is subsequently applied. This has the result:
   - 1.1 of providing an inner corrosion protection, of which the effectiveness, in quality levels, can be adapted to the local requirements by means of an appropriate material selection, and
   - 1.2 in a partial stiffening of the assembled wires to obtain a flexural-elastic total bundle unit, which is important for the success of the subsequently described installation process.
2. Wrapping around a metal band, which is continuously unwound from a drum concurrently with the progress of the work, of various materials and qualities, primarily 0.8–1 mm thick steel sheet. This is done by known and proven processes utilizing roller beds and a drawing nozzle (see FIGS. *2a* and *2b*) so that a closed cylindrical tubular cover results, of which the longitudinal seam is welded by a proven inert gas welding process under an enclosure, e.g., a bell, with the action of a protective gas, for example argon. The welding is done with great care and under an appropriately produced pressure, with a welding factor of 0.9, if possible 1. The tubular cover is mechanically freed of scale and treated with suitable acids (in the case of chrome-nickel steel sheet, for example, a nitric acid mixture of about 50% nitric acid and 50% water).

Contrary to known proposals, the tubular shell described in (2) is pressed solidly, without gap, to the steel wire core on the inside, by means of appropriately shaped roller beds. However, since a welding of the sheetmetal shell cannot be allowed immediately adjacent to the very sensitive wires, a spacing groove is formed on the edges of the sheet by means of sheet crimping which is appropriately carried out automatically by the roller bed. This precautionary measure, which is designated as "welding joint" (see FIG. 3*a*) can have various forms. For example, a trapezoid form is illustrated here, in which a short, longitudinal rod, which is correspondingly formed, called a "welding sword," runs in connection with the welding apparatus. This "welding sword" possesses a bore through which a cooling gas, for example argon gas, can be continuously pumped during the welding process, so that the effect of heat can be reliably kept from the wires on the inside during the welding. For example, this "welding joint" can be located on the top of the tubular shell. On the opposite side, a longitudinal flat corrugation, the "expansion corrugation" is pressed in by one roller during the deformation of the sheet shell (see FIG. 3*b*) where the enveloping tubular shell does not lie against the parallel wire bundle, so that here, as inside the oppositely arranged "welding joint," two longitudinal voids along the parallel wire bundle with spring effect result, of which the order of magnitude must be a function of the functions ascribed to them.

Theoretically, all metals which can be reliably welded or soldered, can be used for the tubular shell. However, to avoid a contact corrosion in abutment to the cast steel anchoring element, contact must here not be made between metallic materials with differing electrolytic potentials, when moisture as electrolyte can produce a conducting connection.

An appropriate selection must therefore be made. Two solutions therefore proved to be primarily advantageous within the scope of this invention:

a. Easily weldable sheet steel of quality ST 37 and St 52, which must be protected on the outside against corrosion by known means, possibly by permanent painting, which requires a monitoring and maintenance and is therefore not completely maintenance-free.

b. Steel band of easily weldable, highly alloyed, permanently passivated steel (high-quality steel), in which, through the addition of so-called "stabilizing elements," the carbon is bonded more rapidly and more stably than the added chromium elements, and the intercrystalline corrosion can be reliably prevented. For this purpose, certain proportions of titanium are usually added, for example. Finally, a pitting resistance can be obtained primarily through the addition of proportions of molybdenum. A type of material which is primarily suitable for these purposes has the following DIN designation:

10 Cr Ni Mo Ti 18 10 and the material No. 1.4571 (U.S. designation: AISI 316 Ti (stabilized)).

At the introduction into the cast steel anchor head, care must be taken that no direct contact can be made between the highly-alloyed high-quality steel and the cast steel (see FIG. 6). This is accomplished by means of an intermediate layer, which is protected against UV radiation, of suitable synthetic materials, for example, polyamide or a similar material which must possess a certain heat resistance during the hot casting of the anchor cone. In addition, the passivity of the tubular shell surface must again be regenerated following the installation, through a treatment with the above-mentioned nitric acid mixture, in all places where it had been soiled during the installation or it has been brought into contact with other metals. Following the fulfillment of the described prerequisites, the tubular shell of highly-alloyed, stabilized high-quality steel is practically maintenance-free for many decades. (Reference is made to the discussions about the general constructional permissibility of non-stainless steels in Mitteilungen des Institutes fuer Bautechnik in Berlin, Feb. 3, 1975.) In accordance with information from recognized metallurgists, the life span of the protective tube exceeds that of the bridge carrier.

Inside of the tubular shell, the wires already largely adhere to the vigorously pressed-in tubular shell. In accordance with this invention, the compression takes place at a point in time at which the hardening process of the very tacky synthetic material, which has been applied or sprayed between the wires and their outer periphery, has not yet taken place. The quantity must therefore be such that some material collects in the gussets of the outer periphery. In order to prevent explosive effects, small quantities of excess material should be accommodated in portions of the spaces of the "welding joint" and the "expansion corrugation." At the completion of the installation, these two channels, which run along the parallel wire bundle, are filled, from the deck of the bridge, with the same synthetic material which was also used inside of the parallel wire bundle for the filling of the gussets, with a correspondingly long adjusted curing time. The sizes of the cross-sections of the "welding joint" and the "expansion corrugation," as well as the quantity of the synthetic material sprayed between the wires, must be adapted to each other.

In order not to expose the tubular shells of sheet metal to the expansion processes which act on the parallel wire bundles after tensioning and the application of dead weight and traffic loads, the tubular shell may not be connected under tension to the anchor element. A telescopic connection, which avoids the assumption of longitudinal tensile forces by the tubular shell, is therefore preferably attached to the anchor element; see FIGS. 6 to 8. A cover shell is produced of the same material as the tubular shell, and, if a maintenance-free corrosion protection is required, it is made of highly-alloyed, stabilized high-quality steel. A screw collar ring of the same material is screwed onto this cover shell. After the production of the parallel wire bundle and the closely enveloping tubular shell at the construction site is complete, a two-part, double longitudinally threaded outer jacket of the same material is placed around the end of the tubular shell, whereby a circular small gap of a few mm must be provided. A few rings with distributed spacers take care of a uniform spacing at all points. The spacers must leave openings free for the later injection of the synthetic material. By means of the above-mentioned screw ring the tubular shell is solidly connected with the cover jacket, and thus with the anchor head. The jacket is shaped so that it can grip around the "welding lock" and the "expansion corrugation" with a small spacing. At the end of the jacket which is away from the anchor head, it is crimped so that it lies closely against the tubular shell. Any gap which remains is plugged with small "Teflon" wedges. A closing circular projection holds a fitted two-part rubber ring, which is pressed together by means of a tightly drawn band of high-quality steel and is rigidly pressed onto the end of the jacket and onto the tubular shell in such a manner that the gap at the end is covered. The length of the jacket must be a function of the largest possible expansion of the parallel wire bundle, so that, even when the adhesion between the tubular shell sheet and the wire core should creep with the course of time under tensile load, the end of the tubular shell will remain inside of the jacket with certainty, and so that the telescopic connection, which does not transmit any tensile forces, is assured. In order to relieve the chromium-nickel steel shell from excessive longitudinal stresses, it is advantageous to permit a bonding of the tubular shell on the resin-filled wire bundle only in the approximate middle one third of the tension member. The adhesive bond on the remainder of the length is decreased by means of mechanically wound-up bands of synthetic resinous webs.

Pressure nozzles, ventilation and control connections must be designed so that the gap between the jacket and the inside tubular shells is also reliably filled at both ends of the parallel wire bundle during the compression of the "welding lock" and "expansion corrugation" described above.

The completed portions of the parallel wire bundle, which are provided with the corrosion protection, are supported at frequent intervals by rolling carts of a certain construction, as they exit from a tent or a room which is protected by prefabricated roof and wall components. They are then moved to the installation site. Immediately after the point of installation the parallel wire bundle, which is enveloped by the tubular shell, is given complete flexural stiffness. In addition to the now already-cured cementing of the wires, strong steel pressure collars (see FIGS. 4 and 5) are placed around the parallel wire bundle at small distances, and are solidly tightened with high tensile strength screws. On the inside, the pressure collars have an insert of hard rubber or synthetic material and have rounded edges. During the compression of the parallel wire bundle by the vertically oriented pressure collars, certain expansions in the horizontal direction can be assumed by elastic deformation of the not-yet filled "welding joint" and "expansion corrugation," in order to thus prevent future tension crack corrosions in the sheetmetal material. Within the pressure collar, free spaces are provided for the deformation processes of the tubular shell, at corresponding places.

In the case of bending, which occurs in the vertical plane with convex tendency during the installation process, the wires which are located at the top and bottom in the bundle assembly attempt to reach the neutral zone and to press the wires which are located there to the outside. In the case of bending, an elliptic form of the free bundle first forms, until finally some of the pressed wires tend to buckle toward the outside and thus try to destroy the bundle assembly. In 1965 and 1966, these processes were confirmed on several occasions in the USA in bundle experiments which were carried out; they were designated as "birdcage effect." ("Advancements in Suspension Bridge Cable Construction" by J. L. Durkee, Congress of International Association for Bridge and Building Construction in Lisbon, 1966, Report, page 435.)

The pressure collars which are arranged at appropriate distances counteract this effect and direct a strong, centrally directed compression force into the bundle by which the wires are forcefully compressed and, under the reinforcement of the adhesive effect of the synthetic material, are prevented from movement with respect to each other or even a breaking of the bundle cross-section. Shear forces develop within the wire configuration which produce a rigid cross-section with a moment of inertia which comprises the total entity, namely: steel wires and filled synthetic material grooves.

The production of as rigid as possible a parallel wire bundle carrier is a prerequisite for the installation of the relatively stiff sheet tubular shells. If, for safety considerations, the stresses in the high-quality steel sheet tubular shell which occur during the installation should not exceed a limit of 78% of the yield stress at 0.2% ultimate elongation (230 $N/mm^2$), i.e., about 180 $N/mm^2$, the following radii of curvature may not be exceeded, for the highly-alloyed high-quality steel having an E modulus $= 1.7 \times 10^5$ $N/mm^2$.

| Number of Wires | Enveloping Circle Diameter mm | Greatest Spacing From the Center mm | Smallest permissible Radius of Curvature mm |
|---|---|---|---|
| 85 | 71.4 | 36.1 | 34 |
| 151 | 94.8 | 53.1 | 50 |
| 253 | 122.4 | 61.6 | 58 |
| 313 | 136.1 | 68.5 | 65 |

In this connection, still other advantageous processing steps are provided in accordance with this invention, with which optionally a complete stiffness of the initially cemented wires can be produced:

1. In short distances from each other, high tensile strength synthetic material ties are drawn directly over the cemented wires;

2. At appropriate distances from each other, high tensile strength metal bands or trusses of pre-stressed wire mesh are applied with high tensile force;

3. Multiple windings of round or profiled wires of steel or high tensile strength synthetic material are tied around the wires of the parallel wire bundle and fastened at both ends under tension; and/or 4. Wire is closely wound around the cemented wires with a considerable tensile force, using devices which are known in suspension bridge construction, in such a manner that the synthetic material which is sprayed between the parallel wire bundle fills the voids and also embeds and thus seals the wound wire layer.

In these cases, the protective sheetmetal skin must be placed around the parallel wire bundle:

a. with a longitudinal welded seam, similar to the example described above, and b. with steel sheet strips which are provided with folded, tight edges, which are continuously placed around the previously tied wire bundle by machine and with considerable tension, using the principle of the "parallel winding process" or by a "multiple winding process" (so-called cross winding process).

The winding machines which are required for this purpose are already in the state of the art and are therefore not described in detail.

In order to make it possible to raise the rigid tension members and to bring them with the anchoring members in stretched form directly in front of the anchoring points in the pylon or in the deck support beam, the installation process is used which is essentially known from the construction of the second bridge over the Rhine at Mannheim-Ludwigshafen. In this case, the parallel wire bundle which is to be raised is uniformly supported from an auxiliary suspension wire which is installed sufficiently high above the pylon, using various rope tackles, and is raised with a just permissible curvature. The suspension wire is held on the installation derrick on the launch side and on the tension block on the land side by two rear anchoring hoists, in order to be able to perform the required side motion by means of this splitting, together with the laterally movable deflection block on the pylon.

The starting process, which can be considered state of the art, is described in the journal "Der Stahlbau", No. 6, Section 4.3 (1973).

Figure 1:
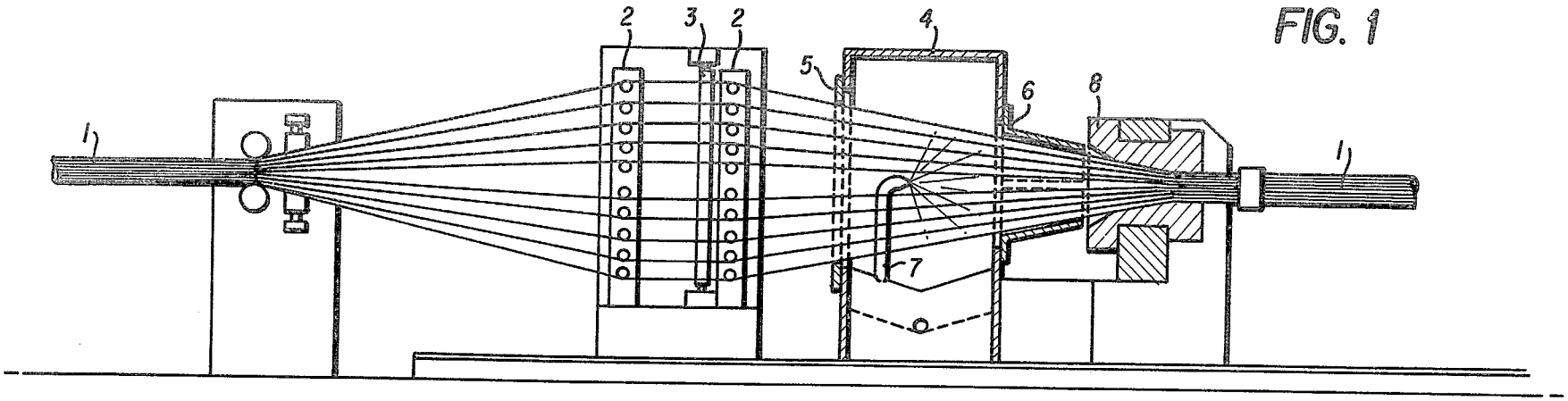
FIG. 1 is a schematic plan view of a part of an apparatus for producing the tension members according to the invention.

Turning now to the drawings, in FIG. 1 there is illustrated an apparatus for the filling of voids within the wires of a parallel wire bundle with a very tacky synthetic resinous material to which has been added an anti-corrosion chemical. The parallel wire bundle 1 (hereinafter designated as PWB) moves through the apparatus from bottom to top in the drawing. It moves through a pair of horizontally removable, ball bearing supported rollers 2 and across a vertically removable ball bearing supported roller 3, whereupon the individual wires of the PWB are spread vertically and horizontally apart. The wires then pass into a two-part spraying bell 4 for the injection of synthetic resinous material containing a preservative into the PWB. At the forward end of the spraying bell is located a two-part elastic frame 5, and a similar two-part elastic frame 6 is located at the outlet of this spraying bell in order to provide a closed spraying chamber. A spraying nozzle 7 for the synthetic resinous material extends from below into the spraying bell and is positioned to spray the synthetic resinous material into the interior of the cone of individual wires formed by the spreading rollers 2 and 3. A two-part trumpet-shaped molding nozzle 8 is provided subsequent to the spraying bell and contains a drain for excess synthetic material. The molding nozzle molds the wires and the resinous material into a desired cross-sectional shape while it brings the wires back into closely spaced relationship.

Figure 2A:
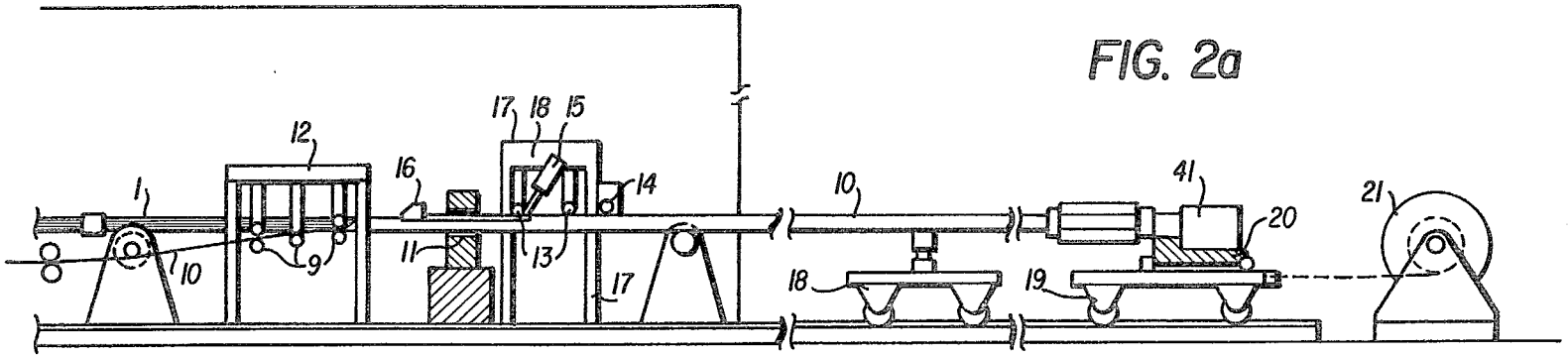
Figure 2B:
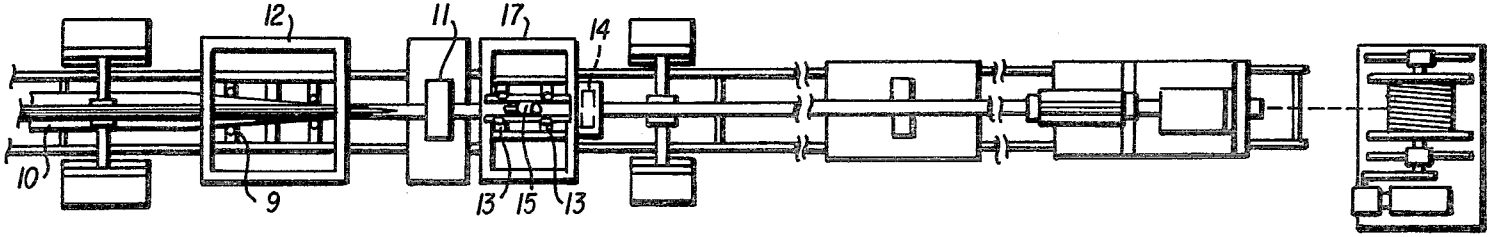

In FIG. 2*a* is illustrated an apparatus for the cold deformation of the enveloping sheetmetal band by means of roller beds, for the purpose of enveloping the PWB and welding a longitudinal seam in the tube of sheet material. FIG. 2*a* is a side view of the apparatus and FIG. 2*b* is a plan view thereof. A series of side rollers 9 are provided for a cold deformation of the sheet metal band into a tubular shell 10 and for firmly pressing the shell onto the PWB, as well as for forming the "welding joint" and for forming the expansion corrugation in the shell. This formation is assisted by a two-part drawing funnel 11 and by pressure rollers ahead of the welding apparatus 15 (e.g., a WIG argon arc inert gas welding apparatus) for compression of the welding joint and the welded seam. A polishing disc 14 is provided subsequent to the point of welding. Cooling gas is supplied at the point of welding by welding sword 16 which enters from behind the point of welding. The parallel wire bundle is transported through the illustrated apparatus in the following manner. The cast steel anchor head 41 of the cable is attached by means of a tiltable bearing 20 to a special car 19 provided for support of the anchor head. This car is attached to a finely adjustable traction device 21 which provides mode of force for the car 19. One or more additional cars 18 are provided for intermediate support of the PWB.

Figure 3A:
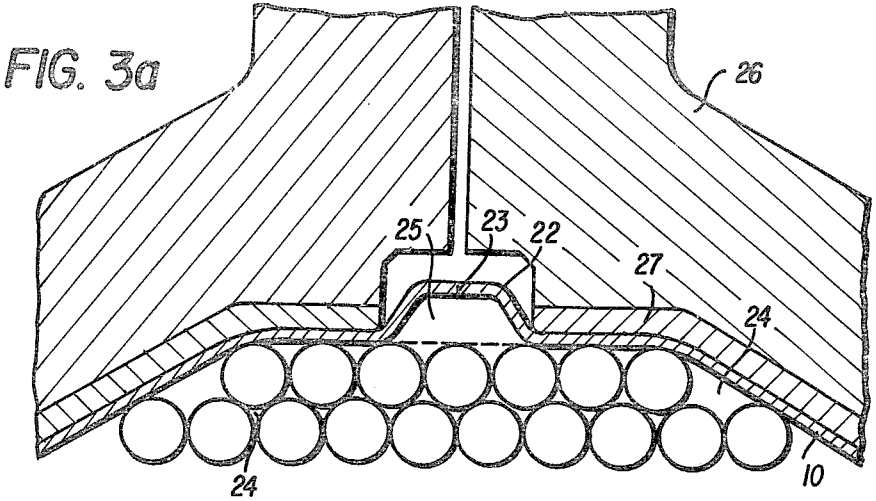

In FIG. 3*a* is illustrated the crimping of the sheet metal band along the edges at one location, e.g., the top, so that a spacing is assured between the heat-sensitive wires of the PWB and the point of welding. At one point in the sheet metal forming the shell 10 there is formed a crimped section 22 on each side of seam 23, in order to form the so-called "welding joint" which provides a space 25 for the purpose of providing the above-mentioned protective spacing. This space 25 is later filled with synthetic resinous material, as are the voids 24 between the wires of the PWB. The compression collar utilized to form the crimped portion of the shell is designated with reference numerals 26, and a hard rubber insert 27 is interposed between the compression collar 26 and the sheet metal sheel 10 during compression as a protective measure.

Figure 3B:
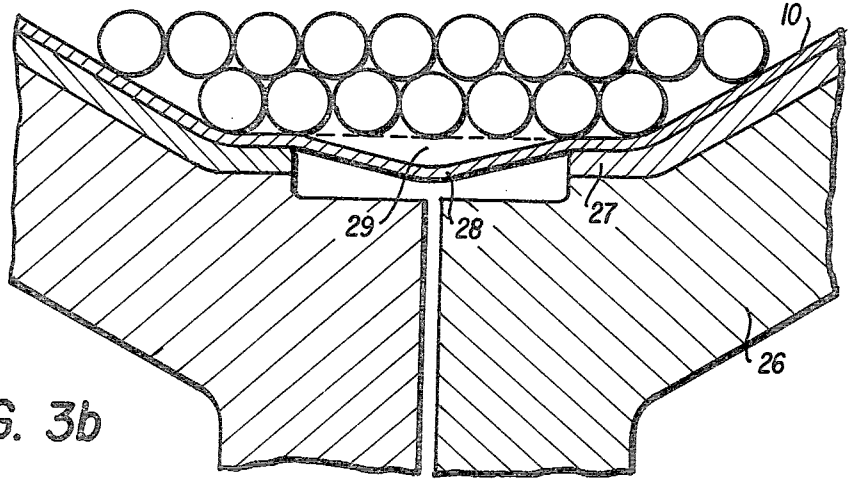

In FIG. 3*b* is illustrated the bottom portion of compression collar 26, again with the interposed insert of hard rubber 27, which is utilized for forming corrugation 28 in the sheet metal shell. A space 29 is formed between the individual wires and the corrugation, which space is also subsequently filled with synthetic resinous material. FIG. 4 illustrates the entire cross-section of the compression collar 26 with hard rubber insert 27. The collar is of two parts held together by bolts 30, and is characterized by a recess 31 for the welding joint and a recess 32 to accommodate the expansion corrugation. FIG. 5 is a side view of the collar 26 illustrated in FIG. 4.

In FIG. 6 is illustrated a means of telescopically attaching the tubular shell to the anchor head 41 of the cable, and particularly the seal associated with this attachment is illustrated. In the anchor head 41 there is located a head plate 42 for holding the individual wires 43 of the cable. An extension shell 44 of high quality steel is inserted into a recess at one end of the anchor head 41 and is surrounded at the point of insertion by an insulating bushing 45, preferably of a heat-resistant synthetic material, e.g., a polyamide or teflon or polyimide.

A two-part tubular jacket 47 of high quality steel surrounds the entire assembly and is threaded on the inside for centering. It is provided with fitted spacers or synthetic material having longitudinal perforation to compensate for compression. The jacket 47 is best seen in FIG. 8 of the drawings. Between the jacket 47 and the tubular shell 10 is a synthetic packing material 53 preferably containing a preservative composition. A pair of pressure and adjustment studs 52 are provided for the synthetic packing material. As may be seen from FIG. 6, the end of the jacket 47 facing away from the anchor 41 is crimped against the tubular shell 10 in a manner designated by reference numeral 49. A two-part rubber sealing collar 50 surrounds this portion of the jacket 47 and is provided on the inside with a round groove adapted to accept not only the crimped portion 49 but also the welding joint 22 and expansion corrugation 28. This rubber collar is cemented by means of adhesive, and after any slits remaining between the crimped portion of the jacket and the tubular shell are sealed with Teflon wedges, the rubber collar is pressed tightly around the entire assembly and is fastened by means of a steel band 51. The rubber collar is the only part which requires maintenance and which requires replacement at certain time intervals.

At the end of the jacket 47 facing the anchor head 41, the assembly is sealed by means of a screw collar ring 46 of high quality steel. This is illustrated more clearly in FIG. 7 of the drawings.

What is claimed is:

1. A process for producing a parallel wire tension member protected from corrosion and for use in cable stayed bridges comprising:

(a) supplying a prefabricated parallel wire bundle from a supply source;

(b) conveying the wire bundle through a spreader and reforming die means to spread the wire strands of the bundle apart without disassembling the bundle and reforming the strands in a parallel wire bundle by collecting them together at the reforming die;

(c) injecting from within the spread strands a tacky synthetic resinous material with an anti-corrosion ingredient to coat all the strands while they are converging towards the reforming die, the resinous material being contained by an injection housing during injection and being sufficient in quantity to completely fill the interstices between the strands after the reforming strip;

(d) applying a close-fitting sheet metal casing to the composite reformed wire bundle and resinous material while the latter is still in tacky condition to thereby enclose same and to bond the casing to at least a portion of the length of the wire bundle, the quantity of the resinous material being sufficient to substantially fill the area between the wires strands and the casing, and the metal casing being longitudinally rigid to the extent that the encased wire bundle cannot be bent beyond a predetermined large radius of curvature without deforming the metal casing;

(e) curing and hardening the resinous material while the encased wire bundle is maintained in substantially straight condition, i.e., with a radius of curvature not smaller than said predetermined radius of curvature.

2. The process according to claim 1, the step of supplying the fabricated wire bundle including supplying the bundle from a single supply reel.

3. The process according to claim 1, said sheet metal casing comprising a single, longitudinally extending corrosion resistant sheet, and the step of applying the sheet to the bundle comprising circumferentially wrapping the metal sheet about the wire bundle with a protective open space beneath the abutting edges only, welding the abutting edges together longitudinally along the bundle, and finally filling the open space with synthetic resinous material, whereby the wire bundle is hermetically sealed by the metal casing.

4. The process according to claim 1, wherein the resinous material is selected from the group consisting of a polyurethane, an epoxy resin and a polyester.

5. The process according to claim 3, including wrapping the sheet metal about the wire bundle while providing a second, longitudinally extending open space between the composite wire bundle and resinous material, and the metal casing, the second open space comprising an expansion space for excess resinous material, and filling any voids in the second area with resinous corrosion protection material.

6. The process according to claim 5, said second open space being protected by locally deforming the metal casing in the space of the second open area.

7. The process according to claim 3, including applying temporary, annular, rigid, radially constricting means at longitudinally spaced intervals along the wire bundle externally of the metal casing.

8. The process according to claim 5, said prefabricated wire bundle including at least one terminal means for securing the wire strands together and anchoring the wire bundle, the metal casing terminating before the terminal means, including the step of applying to the metal casing a longitudinally adjustable enclosing means adjacent the terminal means for enclosing and sealing the wire bundle between the end of the metal casing and the terminal means, and thereafter filling any open portions of said first and second open areas and the interior of said enclosing means with an anti-corrosive synthetic resin material.

9. The process according to claim 1, including applying to the metal casing an outer corrosion protective layer comprising a glass-fiber reinforced unsaturated polyester containing a minor amount of an acrylic polymer admixed therewith.

10. The process according to claim 1, said synthetic resinous material comprising a polyurethane, the process further including the steps of wrapping said reformed wire bundle with a plurality of layers of butyl rubber coated foil and vulcanizing said layers together by heat.

11. The process according to claim 1, including tightly winding wire under tension around the reformed and resin filled wire bundle with the quantity of resinous material being sufficient to seal the wound wire layer before the sheet metal casing is applied.

12. Apparatus for producing a tension member comprising a bundle of parallel wire strands protected from corrosion and for use in cable stayed bridges comprising:

(a) means for spreading the wire strands apart without disassembly of the bundle;

(b) means, spaced from said spreading means, for reforming the wire strands into the bundle;

(c) an injection housing positioned between said spreading and reforming means and defining a chamber including a longitudinal passage therethrough;

(d) means for conveying the wire bundle through said longitudinal passage and through said spreading and reforming means to spread the wire strands of the bundle apart without disassembling the bundle and reforming the strands in a parallel wire bundle by collecting them together at the reforming means;

(e) means including an injection nozzle in said chamber for injecting from within the spread strands a tacky synthetic resinous material with an anti-corrosion ingredient to coat all the strands while they are converging towards the reforming means, the resinous material being contained by the injection housing during injection and being sufficient in quantity to completely fill the interstices between the strands after conveying through the reforming means; and (f) means, located subsequent to said reforming means, for applying a close-fitting sheet metal casing to the composite reformed wire bundle and resinous material while the latter is still in tacky condition to thereby enclose same and to bond the casing to the wire bundle, wherein the quantity of the resinous material is sufficient to substantially fill the area between the wire strands and the casing, and the metal casing being longitudinally rigid to the extent that the encased wire bundle cannot be bent beyond a predetermined large radius or curvature without deforming the metal casing.

13. Apparatus as recited in claim 12, wherein said casing applying means comprises means for continuously supplying sheet metal strip stock and tightly wrapping the sheet metal strip circumferentially about the reformed bundle while it is conveyed so that a single longitudinal seam is presented along the bundle, and welding means for continuously welding the seam closed after the metal has been wrapped.

14. Apparatus as recited in claim 13, including roller means for supporting the distal end of the reformed and encased wire bundle and intermediate areas of said bundle while the bundle is being conveyed.

15. A process for producing a parallel wire tension member protected from corrosion and for use in cable stayed bridges comprising the steps of:

(a) supplying a prefabricated parallel wire bundle from a supply source;

(b) conveying the wire bundle through a spreader and reforming die means to spread the wire strands of the bundle apart without disassembling the bundle and reforming the strands in a parallel wire bundle by collecting them together at the reforming die;

(c) injecting from within the spread strands a tacky synthetic resinous material with an anti-corrosion ingredient to coat all the strands while they are converging towards the reforming die, the resinous material being contained by an injection housing during injection and being sufficient in quantity to completely fill the interstices between the strands after the reforming strip;

(d) tightly winding wire under tension around the reformed and resin filled wire bundle, with the quantity of resinous material being sufficient to also seal the wound wire layer; and (e) applying a close-fitting sheet metal casing in the form of continuously helically wound sheet metal strips under tension about the composite reformed, wire-wound, resin-filled wire bundle while the resinous material is still in tacky condition to thereby enclose same and to bond the casing to the wire bundle, the quantity of the resinous material being sufficient to substantially fill the area between the wire strands and the casing, and the metal casing being longitudinally rigid to the extent that the encased wire bundle cannot be bent beyond a predetermined large radius of curvature without deforming the metal casing.

16. The process according to claim 1, wherein said sheet metal casing comprises a highly-alloyed, stabilized, high-quality steel.

* * * * *

UNITED STATES PATENT OFFICE

CERTIFICATE OF CORRECTION

Patent No. 4,192,057 Dated March 11, 1980

Inventor(s) Wolfgang BORELLY

It is certified that error appears in the above-identified patent and that said Letters Patent are hereby corrected as shown below:

In Column 1, line 31, kindly delete "1000 KN" and insert instead -- 10 000 KN --.

In Column 1, line 66, kindly delete "corrosion" and insert instead -- corrosion- --.

In Column 2, line 49, kindly delete "transporable" and insert instead -- transportable --.

In Column 5, line 42, kindly delete "ST 37" and insert instead -- St 37 --.

Signed and Sealed this

*Twenty-third* Day of *September 1980*

[SEAL]

*Attest:*

SIDNEY A. DIAMOND

*Attesting Officer*

*Commissioner of Patents and Trademarks*